US010980374B2

(12) United States Patent
Paige

(10) Patent No.: US 10,980,374 B2
(45) Date of Patent: Apr. 20, 2021

(54) BATHING WATER CONTAINMENT KIT AND APPARATUS

(71) Applicant: Doris Paige, Everett, WA (US)

(72) Inventor: Doris Paige, Everett, WA (US)

( * ) Notice: Subject to any disclaimer, the term of this patent is extended or adjusted under 35 U.S.C. 154(b) by 17 days.

(21) Appl. No.: 16/287,265

(22) Filed: Feb. 27, 2019

(65) Prior Publication Data

US 2019/0374070 A1 Dec. 12, 2019

Related U.S. Application Data

(60) Provisional application No. 62/682,252, filed on Jun. 8, 2018.

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/608
See application file for complete search history.

(56) References Cited

U.S. PATENT DOCUMENTS 3,879,806 A 4/1975 Armstrong
5,070,551 A 12/1991 Harrison et al.
5,829,071 A * 11/1998 Lavalle ..... A47K 3/001 4/580
8,122,531 B2 2/2012 Li
2004/0231044 A1 11/2004 Carter
2004/0231045 A1 11/2004 Carter
2006/0185072 A1* 8/2006 Dyckow ..... A47K 3/38 4/609
2008/0289095 A1* 11/2008 Li ..... A47K 3/38 4/610
2009/0083904 A1* 4/2009 Roston ..... A47K 3/38 4/558
2011/0126349 A1* 6/2011 Betzen ..... A47K 3/38 4/609
2018/0255979 A1* 9/2018 Moore ..... A47K 3/38
2019/0380545 A1* 12/2019 Bradbury ..... A47K 3/38

* cited by examiner

*Primary Examiner* — Jeremy Carroll
(74) *Attorney, Agent, or Firm* — Boudwin Intellectual Property; Daniel Boudwin

(57) ABSTRACT

A kit for containing water within a bathing space, and a bathing space with components of the kit installed thereto. The kit includes a shower curtain with an extended portion, and a plurality of seam liners configured to adhere to portions of the bathing space with caulk or seams thereon. The extended portion of the shower curtain extends from a main portion of the shower curtain into the bathing space and prevents water from escaping to an exterior of the bathing space. The plurality of seam liners are adhered to portions of the bathing space to protect caulk or seams. The kit is useful for extending a lifespan of the bathing space, and for preventing water accumulation and resulting damage to a floor of a bathroom.

1 Claim, 4 Drawing Sheets

BATHING WATER CONTAINMENT KIT AND APPARATUS

CROSS REFERENCE TO RELATED APPLICATIONS

This application claims priority under 35 U.S.C. § 119(e) to U.S. Provisional Application No. 62/682,252 filed on Jun. 8, 2018. The above identified patent application is incorporated by reference herein in its entirety to provide continuity of disclosure.

FIELD OF THE INVENTION

The present invention relates to a kit for containing water with a bathing space, and a bathing space with components of the kit installed thereto.

BACKGROUND OF THE INVENTION

Ordinary bathing spaces, such as bathtubs and showers, may be equipped with a shower curtain rod that is intended to contain water with the bathing space when used in combination with a shower curtain attached thereto. However, even though the shower curtain rod may extend a length of the bathing space, due to the design of a typical rod and curtain assembly, there often exists gaps on either or both ends of the shower curtain that fails to prevent water from escaping the bathing space and wetting an exterior of the bathing spaces, such as a floor of a bathroom. This escaped water can damage the floor of the bathroom over time, resulting in costly repairs.

Further, due to the construction of the bathing space itself, there are often seams or cracks between adjacent surfaces or walls of an interior of the bathing space, and water can get into these cracks, causing further damage to the bathroom or adjacent rooms or structures. Caulk may be used to seal or cover these seams. However, caulk can break down over time and upon exposure to the elements, and is not a reliable sealant by itself.

Therefore, there is a need in the art for a kit for containing water with a bathing space, and a bathing space with components of the kit installed thereto. The present invention addresses this unmet need.

Items have been disclosed in the art that relate to water containment within a bathing space. These include items that have been patented and published in patent application publications. These items often fail to contain bathing water with a bathing space, such as a bathtub or a shower. In view of the items disclosed in the art, it is submitted that there is a need in the art for an improvement to existing bathing water containment items. In view of the present disclosure, it is submitted that the present invention substantially diverges in structural and functional elements from items in the art, and substantially fulfills an unmet need in the art.

SUMMARY OF THE INVENTION

In view of the disadvantages inherent in the known types of bathing water containment items in the art, the present invention provides a new and improved bathing water containment kit and apparatus, wherein the same can be utilized for both preventing bathing water from escaping a bathing space and for protecting seams of an interior of the bathing space.

It is therefore an object of the present invention to provide a bathing water containment kit for installation to a bathing space, to produce an apparatus of the invention in the form of a bathing space with components of the kit so installed.

In one aspect, the invention provides a kit for containing water in an interior of a bathing space, comprising: a shower curtain with an extended portion that extends from a main portion of the shower curtain into the interior; and one or more seam liners configured to cover one or more seams of the interior.

In another aspect, the invention provides a bathing space having an interior for bathing, comprising: a shower curtain with an extended portion that extends from a main portion of the shower curtain into the interior; and one or more seam liners that cover one or more seams of the interior.

Another object of the present invention is to provide a bathing water containment kit and apparatus that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
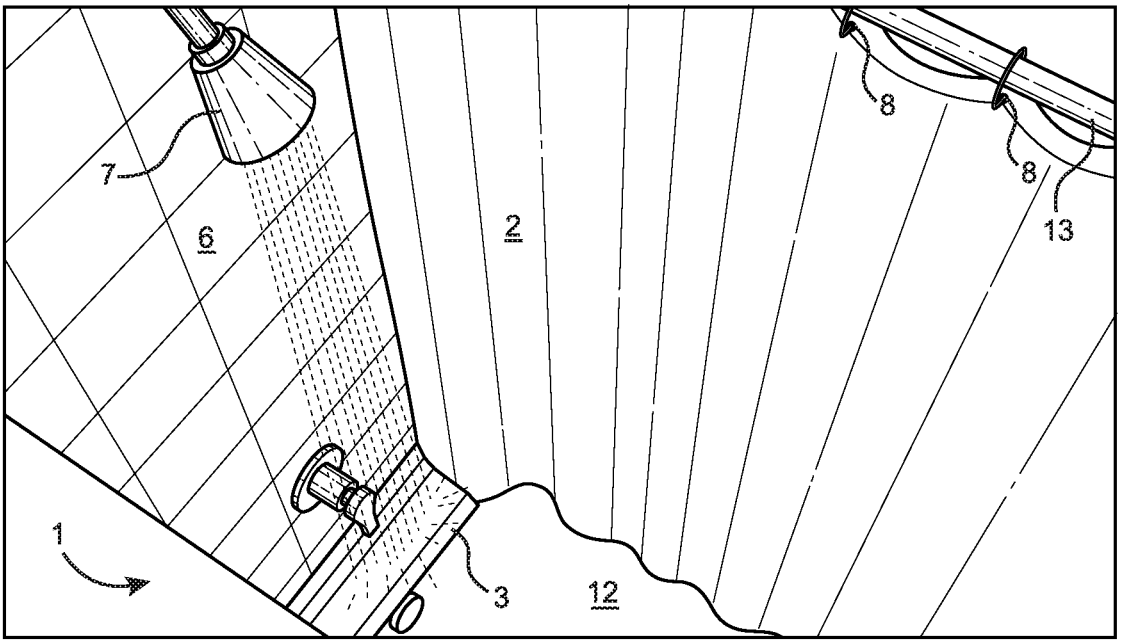
FIG. 1 depicts a perspective view of a bathing space of the present invention, with an exemplary shower curtain and an exemplary horizontal seam liner installed thereto.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Referring now to FIGS. 1-6, there are depicted several perspective views of a bathing space of the present invention, with an exemplary shower curtain and an exemplary horizontal seam liner installed thereto. A bathing space 1 includes components of a kit for containing water in an interior 12 of the bathing space installed. The kit includes a shower curtain 2 with an extended portion that extends from a main portion of the shower curtain 2 into the interior 12, and one or more seam liners, for example, a horizontal seam liner 3 and vertical seam liners 4, configured to cover one or more seams or cracks of the interior.

In some embodiments, the shower curtain 2 includes a plurality of apertures 8 along an upper edge thereof, and the plurality of apertures 8 is configured to accept a plurality of suspension rings therethrough to slidably suspend the shower curtain on a structure. In the shown embodiment, the structure is a shower curtain pole 13, and the shower curtain pole 13 is engaged with opposing walls of an area of the bathing space 1, for example, a first wall adjacent to a bathing space wall 6 (having a shower head 7 thereon) for accepting the extended portion of the shower curtain 2 thereon. In this manner, the shower curtain 2 may be opened and closed by pulling on the curtain, which slides the suspension rings along the shower curtain pole 13.

Figure 2:
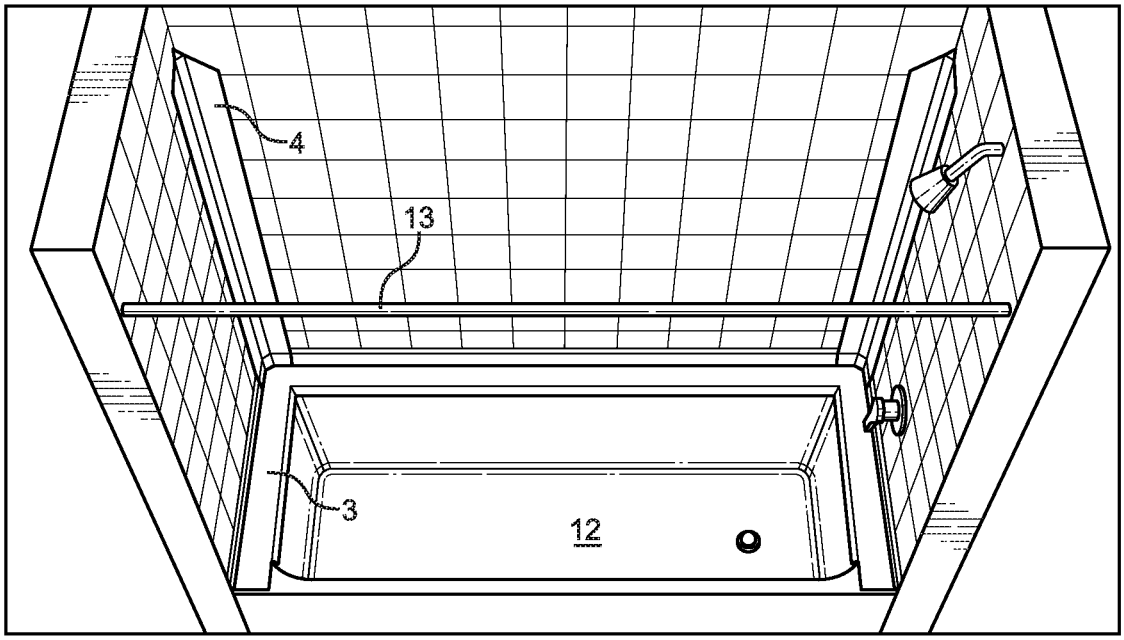
FIG. 2 depicts a perspective view of the bathing space of the present invention, with the exemplary horizontal seam liner and an exemplary vertical seam liner installed thereto.
Figure 3:
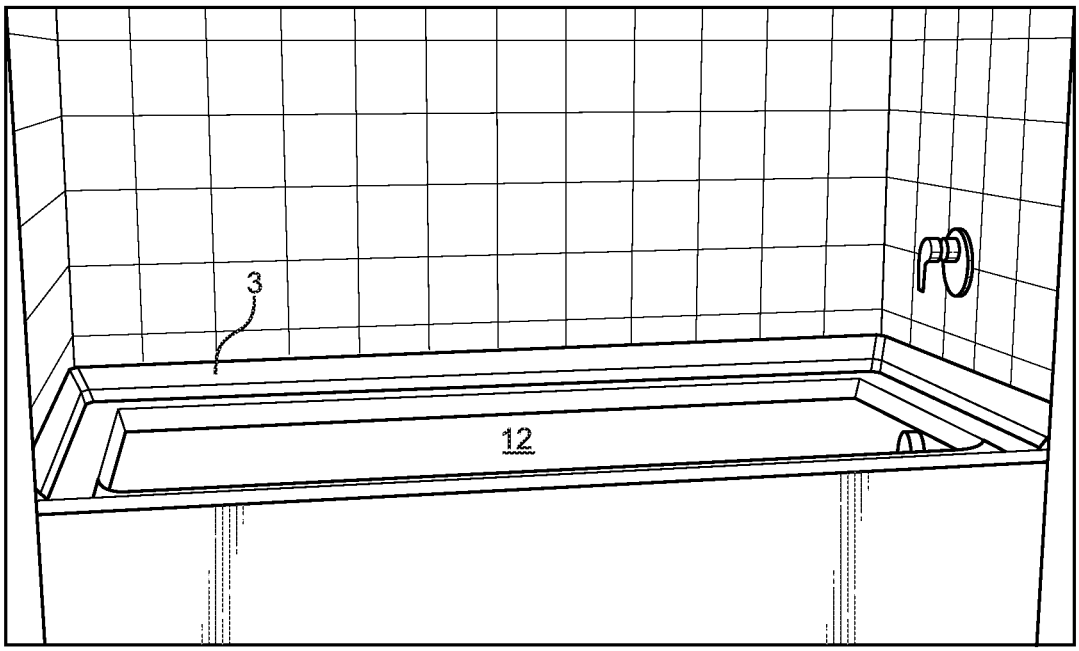
FIG. 3 depicts a perspective view of the bathing space of the present invention, with the exemplary horizontal seam liner installed thereto.
Figure 4:
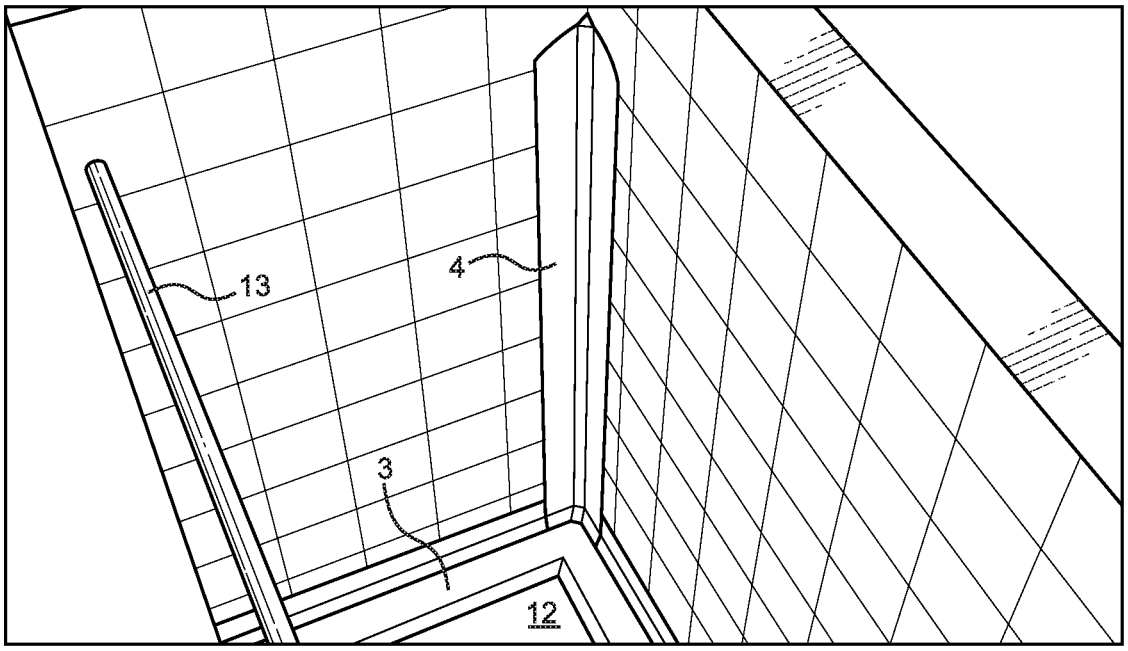
FIG. 4 depicts a perspective view of the bathing space of the present invention, with the exemplary horizontal seam liner and the exemplary vertical seam liner installed thereto.

Referring now to FIGS. 2-4, there are depicted perspective views of the bathing space of the present invention, with horizontal (FIGS. 2-4) and vertical (FIGS. 2 and 4) seam liners installed thereto. In the shown embodiment, the shower curtain has been removed from the shower curtain pole 13 to illustrate the seam liners. In the shown embodiment, the horizontal seam liner 3 is one unitary piece so as to minimize leakage of bathing water into a seam or a crack of the interior 12 of the bathing space. In alternate embodiments, the horizontal seam liner 3 may be two or more pieces to facilitate transport and assembly when needed.

Generally, the horizontal seam liner 3 may be included and installed according to need, for example, if the seam or the crack between a bathtub or a shower base and a wall of the interior 12 is in particular need of protection. In some embodiments, a horizontal seam liner 3 is included along with one or more vertical seam liners 4. The vertical seam liner 4 is configured to protect a seam or a crack between walls of the interior 12.

Generally, the seams or cracks coverable by the vertical seam liner 4 may occur at right angles within corners of the interior 12, as would be understood by those in the art. However, in some embodiments, the seams or cracks to be covered by the vertical seam liner 4 may have an angle that is greater than ninety degrees, for example, as may be found in a hexagonal shower or bathtub space or interior 12, or a bathing space having any other particular shape. Accordingly, it is envisioned that an angle of the vertical seam liner 4 may be adjusted or flexible, or even defined by the angle of the seams or cracks to be covered thereby.

In some embodiments, one or more horizontal and/or vertical seam liners of the one or more horizontal and/or vertical seam liners is selected from a group of seam liners including, but not limited to: an adhesive, an adhesive foam, a polymer covering, a polymer coating, and any combination thereof. In some embodiments, the horizontal and/or vertical liner includes a polymer covering in combination with an adhesive or an adhesive foam, so as to attach the liner to one or more seams or cracks in need of covering within the interior 12. In various embodiments, the one or more seams or cracks includes a caulk sealant thereon. The caulk sealant may have been installed at the time when the ordinary bathing space was installed. In this case, the caulk sealant may have eroded or degraded to a certain degree, which results in water escaping therethrough. This escaped water can damage nearby structures, and so particularly in these cases, if caulk is irreparable without re-finishing the bathroom, a convenient and cost-effective solution is to utilize one or more horizontal and/or vertical seam liners according to the present invention.

Figure 5:
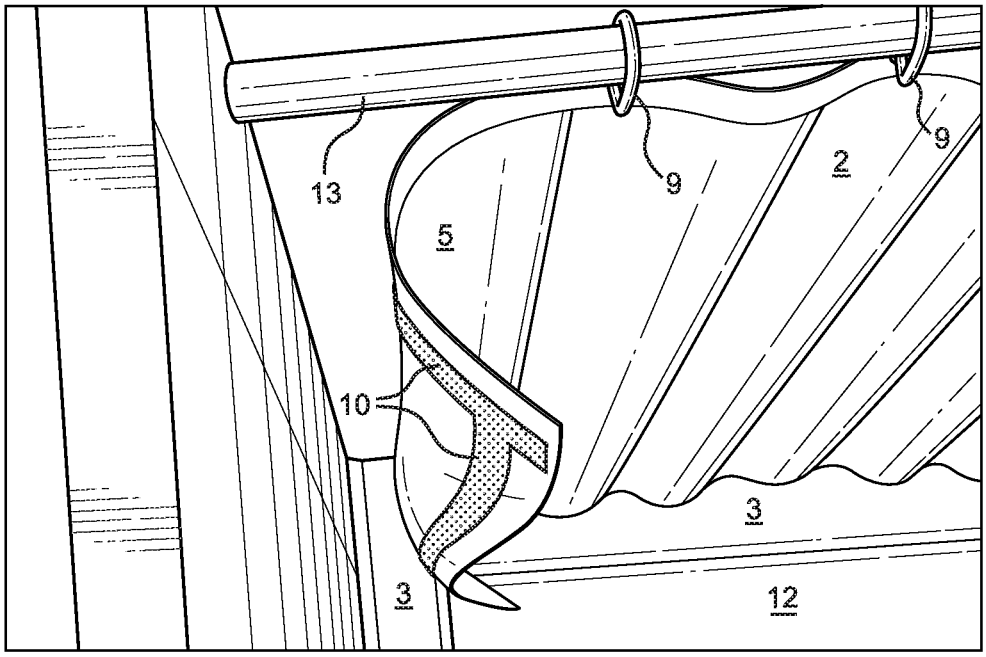
FIG. 5 depicts a close-up perspective view of the exemplary shower curtain, with an adhesive attachment mechanism for securing an extended portion of the shower curtain to a wall of an interior of the bathing space.
Figure 6:
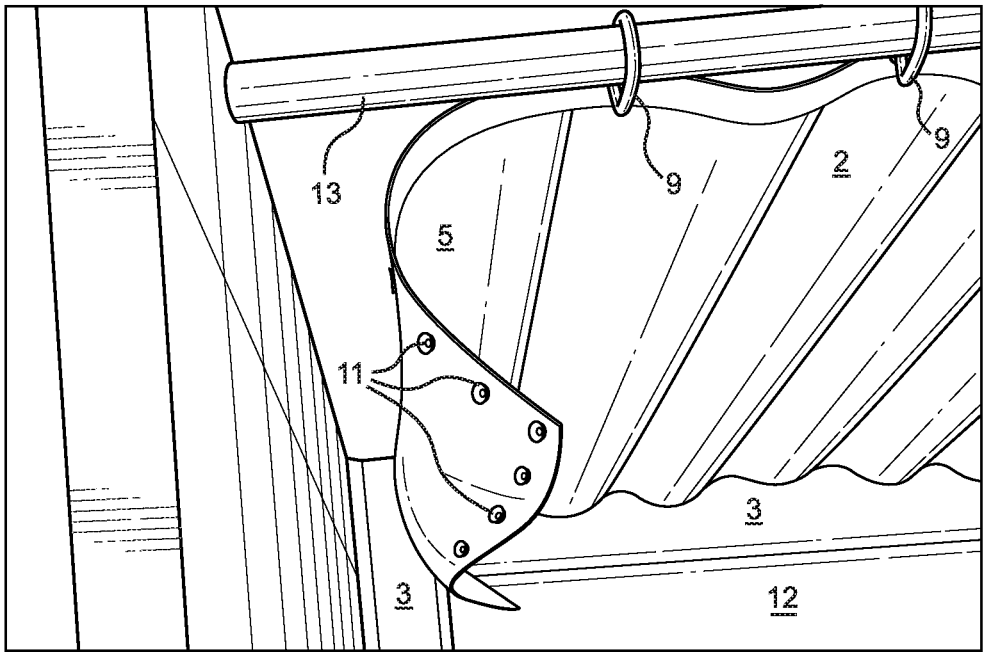
FIG. 6 depicts a close-up perspective view of the exemplary shower curtain, with a suction cup attachment mechanism for securing the extended portion of the shower curtain to the wall of the interior of the bathing space.

Referring now to FIGS. 5 and 6, there are depicted close-up perspective views of the exemplary shower curtain, with an adhesive attachment mechanism (FIG. 5) or a suction cup attachment mechanism (FIG. 6) for securing the extended portion of the shower curtain to a wall of the interior of the bathing space. In the shown embodiment, the extended portion 5 extends from the main portion of the shower curtain 2, wherein the main portion refers to a portion of the shower curtain 2 having the plurality of suspension rings 9 on an upper edge or portion thereof. However, in alternate embodiments, the plurality of suspension rings 9 may be attachable to the extended portion 5 through the plurality of apertures, if the plurality of apertures extends into the extended portion 5. In this manner, in certain embodiments, the extended portion 5 may be used optionally according to need.

In some embodiments, the extended portion 5 is attachable to the wall 6 of the interior 12 by a suitable attachment mechanism. In some embodiments, the attachment mechanism may be selected from a group including, but not limited to: a tape, a double-sided tape, an adhesive, a double-sided tape adhesive, (collectively, 10) a suction cup, a plurality of suction cups 11, and any combination thereof. Generally, the attachment mechanism may vary, but in particular embodiments, it may be desirable to utilize the plurality of suction cups 11. In this manner, the extended portion 5 may be securely sealed to the wall of the interior 12 to prevent water from escaping the interior 12. In the event that water trickles down a surface of the extended portion 5 which has the plurality of suctions cups 11 thereon, a pattern or a layout of the suction cups 11 may direct the water toward a drain of the interior 12, instead of out of the bathing space.

Figure 7:
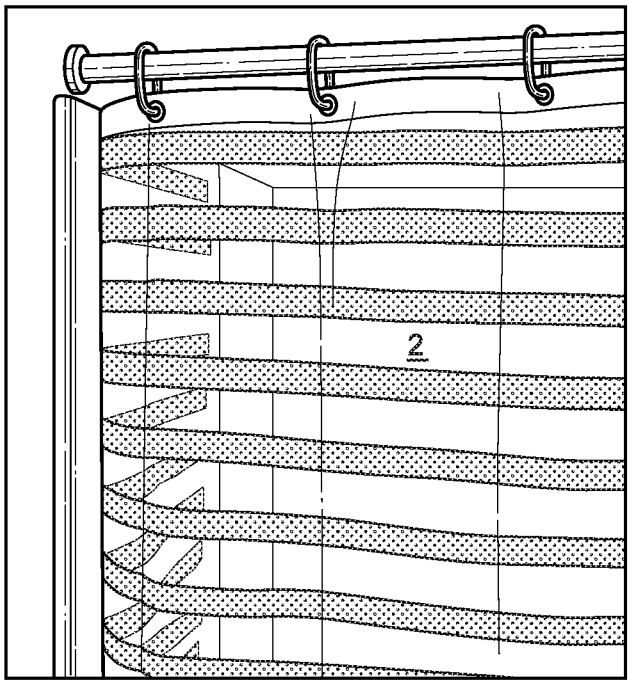
FIG. 7 depicts an outside perspective view of the exemplary shower curtain, having the extended portion which extends from a main portion of the shower curtain into the interior of the bathing space.
Figure 8:
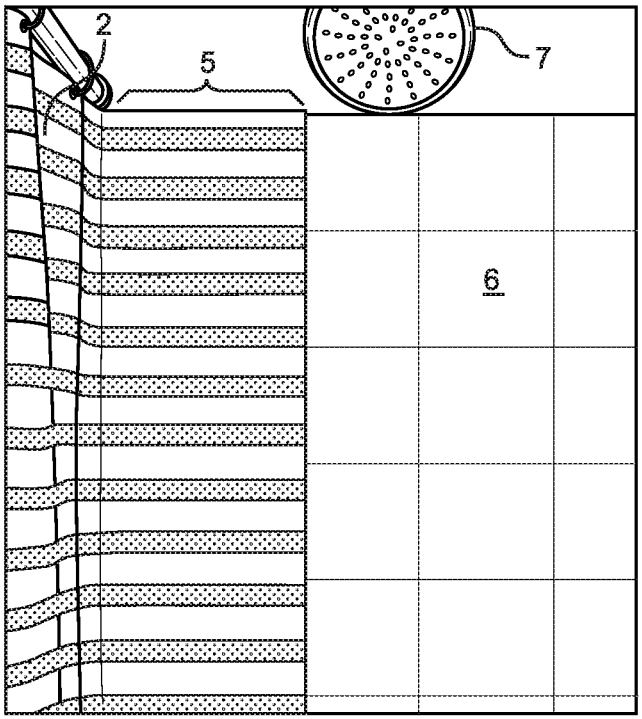
FIG. 8 depicts an inside perspective view of the exemplary shower curtain, having the extended portion which extends from the main portion of the shower curtain into the interior of the bathing space.

Referring now to FIGS. 7 and 8, there are depicted an outside perspective view (FIG. 7) and an inside perspective view (FIG. 8) of an exemplary shower curtain, having an extended portion which extends from a main portion of the shower curtain into an interior of the bathing space. The shower curtain 2 includes the extended portion 5 thereon, which extends significantly into the interior of the bathing space. In the shown embodiment, the extended portion 5 extends toward, and reaches or nearly reaches, the shower head 7 positioned on the wall 6. In this manner, the interior of the bathing space is more effectively sealed to prevent water from escaping the interior of the bathing space.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A kit for containing water in an interior of a bathing space, consisting of:

a shower curtain with an extended portion that extends from a main portion of the shower curtain into an interior of a bathing space;

wherein the extended portion is attachable to a wall of the interior of the bathing space by an attachment mechanism;

wherein the shower curtain includes a plurality of apertures along an upper edge thereof for securing the shower curtain to a shower curtain pole;

wherein the plurality of apertures is configured to accept a plurality of suspension rings therethrough to slidably suspend the shower curtain on a structure; and a plurality of seam liners configured to cover seams of the interior of the bathing space.

* * * * *